US007060007B2

(12) United States Patent
Juva

(10) Patent No.: US 7,060,007 B2
(45) Date of Patent: Jun. 13, 2006

(54) TREADMILL

(75) Inventor: Jussi Juva, Turku (FI)

(73) Assignee: Tunturi Oy LTD, Turku (FI)

( * ) Notice: Subject to any disclaimer, the term of this patent is extended or adjusted under 35 U.S.C. 154(b) by 0 days.

(21) Appl. No.: 10/814,149

(22) Filed: Apr. 1, 2004

(65) Prior Publication Data

US 2004/0242379 A1 Dec. 2, 2004

(30) Foreign Application Priority Data

Apr. 17, 2003 (FI) ..... 20030592

(51) Int. Cl.
*A63B 22/02* (2006.01)

(52) U.S. Cl. ..... 482/54; 482/51

(58) Field of Classification Search ..... 482/51, 482/54

See application file for complete search history.

(56) References Cited

U.S. PATENT DOCUMENTS 5,772,560 A 6/1998 Watterson et al.
5,855,537 A 1/1999 Coody et al.
5,868,648 A 2/1999 Coody et al.
5,899,834 A 5/1999 Dalebout et al.
5,921,893 A 7/1999 Hurt
6,033,347 A * 3/2000 Dalebout et al. ..... 482/54
6,273,843 B1 8/2001 Lo
6,325,745 B1 12/2001 Yu
6,461,275 B1 10/2002 Wang et al.
6,475,121 B1 11/2002 Wang et al.
6,733,422 B1 * 5/2004 Wu et al. ..... 482/54
6,905,443 B1 * 6/2005 Lo ..... 482/54
2002/0068664 A1 6/2002 Tsou
2002/0173408 A1 11/2002 Wang
2002/0183169 A1 12/2002 Chang

* cited by examiner

*Primary Examiner*—Stephen K. Cronin
*Assistant Examiner*—Tam Nguyen
(74) *Attorney, Agent, or Firm*—Birch, Stewart, Kolasch & Birch, LLP

(57) ABSTRACT

A treadmill that includes a frame supported against the floor at its front and back sections, a belt section arranged on the frame, first device for turning the belt at a desired speed, and second device for adjusting the tilt of the belt section with respect to the horizontal, and a hand support structure extending upward from the plane of the frame in the operating position of the treadmill and comprising a support part on both sides of the frame. Extending from both support parts, there are low supports forming a low frame that are arranged to extend substantially parallel to the frame in the operating position of the treadmill and to rest against the floor at least in the area of the ends. The entity formed by the support parts and the low frame is turnably pivoted to the frame by means of a transverse shaft of the frame so that when the frame is lifted upright on one end, the entity formed by the support parts and low frame turns around the shaft, which is transverse to the frame, so that the ends of the low supports rest against the floor and form points of support to keep the frame upright.

10 Claims, 1 Drawing Sheet

TREADMILL

Figure 1:
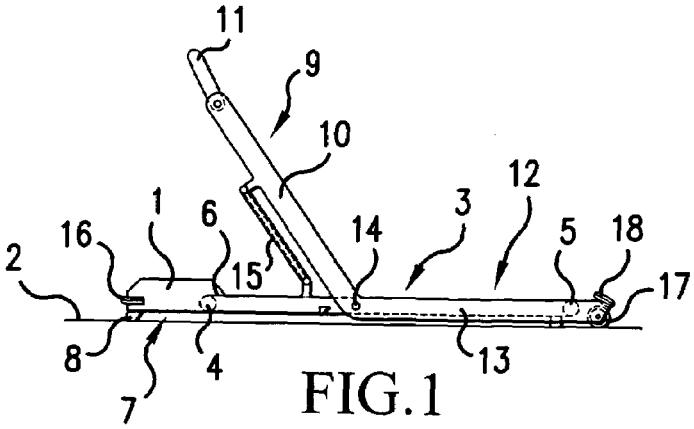

This Nonprovisional application claims priority under 35 U.S.C. § 119(a) on Patent application Ser. No(s). 20030592 filed in FINLAND on Apr. 17, 2003, the entire contents of which are hereby incorporated by reference.

The invention relates to a treadmill that comprises a frame supported against the floor at its front and back sections, a belt section arranged on the frame and comprising a belt arranged in an endless loop around two rolls at a distance from each other, first means for turning the belt around a front roll and a back roll at a desired speed, and second means for adjusting the tilt of the belt section with respect to the horizontal, and a hand support structure extending upward from the plane of the frame in the operating position of the treadmill and comprising a support part on both sides of the frame.

Treadmills are today very popular devices, and they are used at gyms and at home for exercises related to keeping fit and to top athletics. Treadmills provide the advantage that they make it possible to do running exercises indoors, whereby the user is independent of weather conditions and large hall space. In addition, the advantage of treadmills when used for keeping fit is that they make it possible to combine exercises with some other activity, such as watching television, which in a way allows for more time for the fitness exercise, because it can be combined with some other activity, such as watching a specific television program.

During home use in particular, it has been noticed that the space required by a treadmill is relatively large in comparison with the available space, so the possibility to turn the treadmill upright, into what is known as the storage and/or transport position when the device is not used, is in practice an important feature. The above-mentioned matters are also important in gym use, because treadmills intended for professional use can be very big. Another advantage is that the total weight of the device is reasonable so as to make moving it simple.

During the years, a variety of treadmills have been manufactured starting from simple basic devices to very versatile devices intended for testing purposes. Examples of known treadmill solutions are devices described in U.S. Pat. Nos. 5,855,537; 8,899,834; 5,921,893; 6,273,843; 6,325,745; 6,461,275; and 6,475,121, and in published U.S. application Ser. No. 2002/0183169.

In known devices, the mechanisms permitting the lifting of the frame into an upright position have been relatively complex solutions. The solutions use different levers, joints, moving points of support in guide elements, and other such details. Due to the complex structure, the need for maintenance of these devices is relatively great. A complex structure also requires a correct attitude from a user; in other words, a solution designed for expert use is not in all cases suitable for an average enthusiast, and on the other hand, a complex structure that is, however, structurally weak, will not endure the rough use sometimes occurring in a gym. The complex structure has also increased the manufacturing costs and increased the weight of the device, which has made moving the device more difficult.

It is an object of the invention to provide a treadmill, by means of which the drawbacks of the prior art can be eliminated. The treadmill of the invention achieves this.

The treadmill of the invention is characterized in that extending from both support parts, there are low supports forming a low frame, and the low supports are arranged to extend substantially parallel to the frame in the operating position of the treadmill, and they are arranged to rest against the floor at least in the area of the ends, and that the entity formed by the support parts and the low frame is turnably pivoted to the frame by means of a transverse shaft of the frame in such a manner that when the frame is lifted upright to rest on one end, the entity formed by the support parts and low frame turns around the transverse shaft in relation to the frame so that the ends of the low supports rest against the floor and form points of support that keep the frame upright.

The invention provides above all the advantage that by means of the invention, it is possible to provide a simple and functional structure. Due to the simple structure, the maintenance need of the treadmill is small, whereby the operating costs of the device are low. As a result of the simple structure, the weight of the device does not become unreasonable, and the handling and moving of the device is easy. Turning the treadmill of the invention upright, i.e. to the transport and/or storage position, is a light operation. Yet, the hand support structure of the treadmill of the invention is very strong. The mechanics of the treadmill of the invention are simple, and the structure also makes it possible to move the device sideways, in which case a wide platform can be used. The invention provides the further advantage that its structure enables the delivery of the device fully assembled and the customer need not assemble it before using it. The solution of the invention enables the turning of the treadmill into its transport and/or storage position at any tilt angle of the treadmill so the use of the device is simple and fast.

Figure 2:
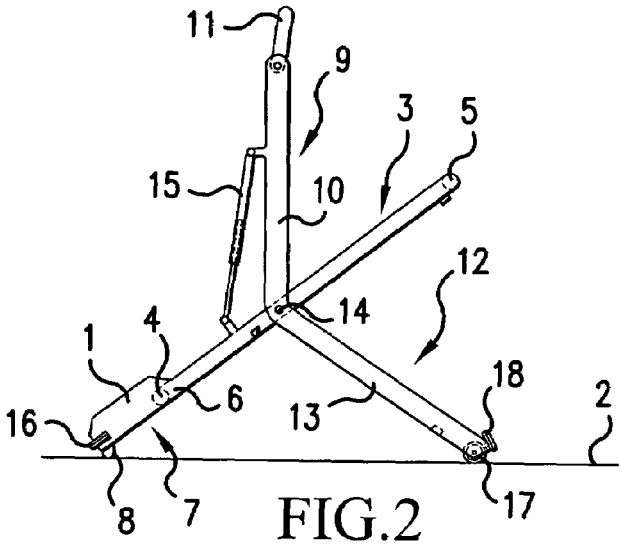
Figure 3:
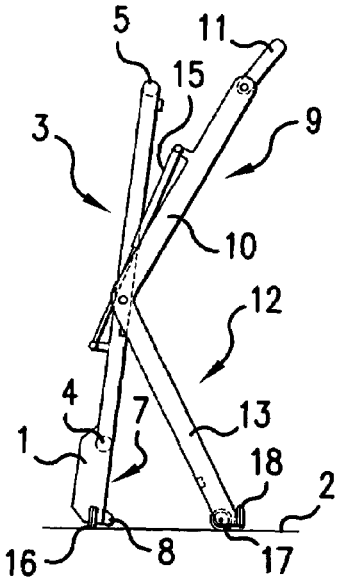
Figure 4:
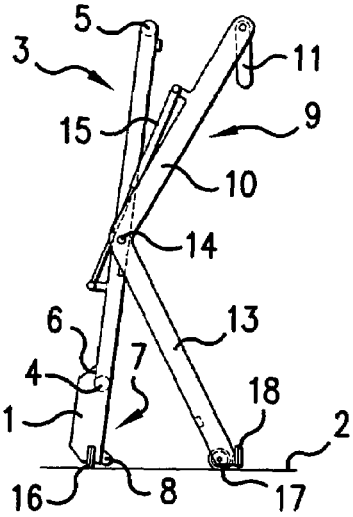

In the following, the invention will be described in greater detail by means of an embodiment of the invention shown in the attached drawing, in which FIG. 1 is a side view of the treadmill of the invention in its operating position, FIG. 2 is a side view of the treadmill of the invention in a situation, in which the frame is being turned upright, FIG. 3 is a side view of the treadmill of the invention in a situation, in which the frame is turned upright, i.e. into the storage and/or transport position, and FIG. 4 is a side view of the treadmill of the invention in a situation, in which the frame is upright and second transport wheels are lowered.

FIG. 1 shows the treadmill of the invention in its operating position, i.e. running position. Reference number 1 marks the frame that is arranged to rest against the floor 2 on its front and back sections. The term 'floor' refers herein to any support surface on which the frame 1 rests. A belt section 3 is arranged on the frame 1 and comprises a belt 6 arranged in an endless loop around two rolls 4, 5 at a distance from each other, the belt forming a plane on which the user of the device runs.

The treadmill further comprises first means 7 for turning the belt 6 around a front roll and a back roll at a desired speed, and second means 8 for adjusting the tilt of the belt section 3 with respect to the horizontal. The first means 7 comprise for instance an electric motor and an appropriate power transmission mechanism. The second means 8 can, in some applications, comprise a suitable power source and a power transmission mechanism, such as an electric motor and rack transmission, or another suitable solution. The second means 8 also comprise floor supports, on which the frame rests oh the floor. The adjustment of the tilt can preferably take place by adjusting the floor supports. The adjustment can be motor-operated or manual.

The treadmill further comprises a hand support structure 9 extending upward from the plane of the frame 1 in the operating position, and the hand support structure comprises a support part 10 on both sides of the frame. The hand support structure can also comprise a control and/or gauge panel 11 of the device. The size and shape of the control and/or gauge panel depends for instance on the adjustment options and other functions of the device.

The above-mentioned facts are entirely conventional technology to a person skilled in the art, so they are not described in more detail herein. In terms of these facts, reference is made to the earlier mentioned US publications for instance.

An essential factor of the treadmill of the invention is that low supports 13 forming a low frame 12 are formed to extend from both support parts 10, and they are arranged to extend substantially parallel to the frame 1 in the operating position of the treadmill and to rest against the floor 2 at least in the area of the ends of the low supports. The above-mentioned detail is clearly shown in FIG. 1.

The entity formed by the support parts 10 and low frame 12 is turnably pivoted to the frame 1 by means of a transverse shaft 14 of the frame in such a manner that when the frame 1 is lifted upright to rest on one end, the entity formed by the support parts 10 and low frame 12 turns around the shaft 14, which is transverse in relation to the frame 1, so that the ends of the low supports 13 rest against the floor 2 and form points of support that keep the frame 1 upright.

The low supports 13 forming the low frame 12 can preferably be arranged to extend past one end of the frame in the operating position of the treadmill; in the example of the figures, the low supports 13 extend past the back end of the frame, as clearly shown in FIG. 1. The above-mentioned transverse shaft 14 can preferably be arranged substantially in the middle of the frame 1 and at the joining point of the support parts 10 and low supports 13. To facilitate the turning movement, at least one element 15 easing the turning movement is arranged between the frame 1 and the entity formed by the support parts 10 and low frame 12. The element 15 easing the turning movement can be a gas spring, for instance. The low supports do not, however, need to extend past one end of the frame in the operating position, but the structure can also be implemented according to the basic idea of the invention in such a manner that the low supports 13 extend parallel to the frame in the operating position of the treadmill and end before the end of the frame. In a corresponding manner, the shaft 14 need not be located in the above-mentioned manner in the middle of the frame, but the shaft can also be located closer to one end of the frame.

To make moving the treadmill easier, transport wheels 16 are arranged to rotate around shafts that are substantially vertical in the operating position, and in the area of the ends of the low supports 13, support wheels 17 are arranged to rotate around shafts that are substantially horizontal. The transport wheels 16 and support wheels 17 and their positions are clearly shown in FIG. 1. Another set of transport wheels 18 can also be arranged in the area of the ends of the low supports 13, which are arranged to rotate around shafts that are substantially parallel with the shafts of the transport wheels 16 at the other end of the frame 1 when the frame 1 is turned upright. The above-mentioned second transport wheels 18 can preferably be made lowerable in the upright position of the frame 1, as shown in FIGS. 3 and 4. FIGS. 3 and 4 also show the parallelism of the shafts of the transport wheels 16 and the shafts of the second transport wheels 18 when the frame 1 is turned upright.

The treadmill of the invention is turned from the operating position to the transport and/or storage position substantially in the following manner. The starting point is the operating position of FIG. 1. When the treadmill is turned into the transport and/or storage position, the locks, with which the frame 1, the support parts 10, and the low frame 12 are locked together, are released and the back section of the frame 1 is lifted upward as shown in FIG. 2. A gas spring 15 assists in this, and the structure, comprising support wheels rolling on the floor 2 at the ends of the low supports 13, provides a good lever arm, thus producing a light lifting action. At this stage, the front section of the frame rests against the floor as shown in FIG. 2. The transport wheels 16 in the front section of the frame do not touch the floor at this stage. The higher the frame is lifted, the smaller is the assistance of the gas spring 15. This provides the lifting of the frame with a feel of standard moment, because the centre of gravity changes at the same time and the force required by the lifting becomes smaller. In this context, it should be noted that the lifting of the frame 1 could be done regardless of what the angle of the frame is in relation to the floor in the operating position.

FIG. 3 shows a situation, in which the frame 1 is turned up-right, i.e. in the transport and/or storage position. The front section of the frame rests on the transport wheels 16 and the support wheels 17 in the area of the ends of the low supports 13 also rest against the floor. The gas spring 15 is at an angle, at which it does not try to lift or lower the frame 1. The structure is locked into the position shown in FIG. 3 for transport or storage.

As described above, when the treadmill is turned into the transport and/or storage position, it also shifts to stand fully on the wheels. An especially preferably solution is to use second transport wheels 18 at the ends of the low supports 13, whereby the second transport wheels 18 can be made lowerable as shown in FIGS. 3 and 4. The treadmill can then be moved sideways, which makes the moving of a wide treadmill simple. The control and/or gauge panel 11 can also be made into a pivoted structure as shown in FIGS. 3 and 4, or it can also be designed so that its fixed structure does not hamper the moving of the treadmill.

It should be noted that the second transport wheels are not necessary, since the treadmill can also be moved by tilting the device slightly so that the wheels 16 or alternatively 17 rise slightly in the air and the device can be moved on the wheel pair resting against the floor.

The embodiment described above is not in any way intended to restrict the invention, and the invention can be modified freely within the scope of the claims. Thus, it is clear that the treadmill of the invention or its details need not be exactly as described in the figures, and solutions of other type are also possible. For instance, in the example of the figures, the first means 7 for turning the belt are located in the front section of the treadmill. The means in question are relatively heavy, so it is clear that the heavier end of the treadmill rests against the floor when the frame is turned upright. If the second means are located in the back section of the treadmill, it is natural that the lighter front section of the treadmill is lifted up when the frame is turned upright. The different elements of the hand support structure and low frame, such as support parts, low supports, etc., are then built conversely to the example of the figures, i.e. for instance the low supports extend past the front end of the frame, etc. The second means 8 used for adjusting the tilt of the frame can, in all embodiments, be either in the front end or the back end of the frame.

The invention claimed is:

1. A treadmill that comprises a frame supported against a floor at its front and back sections, a belt section arranged on the frame and comprising a belt arranged in an endless loop around two rolls at a distance from each other, first means for turning the belt around said rolls at a desired speed, and second means for adjustably tilting the belt section with respect to a floor, and a hand support structure extending upwardly from the frame is resting horizontally on a floor when the tredmill is in an operating position and comprising a support part on both sides of the frame, and low supports forming a low frame extending from both support parts, and extending substantially parallel to the frame in the operating position of the treadmill and resting against the floor at least in an area of the ends of the low supports wherein the support parts and the low frame forms an entity that is turnably pivoted to the frame by means of a transverse shaft on the frame, and the entity is turnably pivoted to the frame so that when the frame is lifted upright on one end, the entity turns with respect to the floor and in relation to the frame around the transverse shaft, so that the ends of the low supports rest against the floor and form points of support to keep the frame upright.

2. A treadmill as claimed in claim 1, wherein the low supports forming the low frame extend past one end of the frame.

3. A treadmill as claimed in claim 2, wherein the transverse shaft is substantially in the middle of the frame.

4. A treadmill as claimed in claim 3, wherein the transverse shaft is located at a point where the support parts join the low supports.

5. A treadmill as claimed in claim 1, wherein at least one element for easing the turning movement is arranged between the frame and the entity.

6. A treadmill as claimed in claim 2, wherein the low supports extend past a back end of the frame.

7. A treadmill as claimed in claim 1, wherein transport wheels are arranged at one end of the frame to rotate around shafts that are substantially vertical when the treadmill frame is in the operating position and that support wheels are arranged in the area of the ends of the low supports to rotate around shafts that are substantially horizontal.

8. A treadmill as claimed in claim 7, wherein second transport wheels are arranged in the area of the ends of the low supports to rotate around shafts that are substantially parallel to the shafts of the transport wheels at the other end of the frame when the frame is turned upright.

9. A treadmill as claimed in claim 8, wherein the second transport wheels are capable of being lowered when the frame is in the upright position.

10. A treadmill as claimed in claim 8, wherein the support parts and the lower supports are fixed in relation to each other.

* * * * *